US010183782B2

(12) United States Patent
Sale et al.

(10) Patent No.: US 10,183,782 B2
(45) Date of Patent: Jan. 22, 2019

(54) BOTTOM-HANDLED BAG HAVING INTEGRAL ERGONOMIC HANDLE FORMED FROM DEFLECTED WELD LINE

(71) Applicants: Mark D. Sale, Kailua Kona, HI (US); Tara J. Saville, Kailua Kona, HI (US); Jay B. Paulson, Kailua Kona, HI (US)

(72) Inventors: Mark D. Sale, Kailua Kona, HI (US); Tara J. Saville, Kailua Kona, HI (US); Jay B. Paulson, Kailua Kona, HI (US)

(73) Assignee: Baldwin Barlow + Baring, Inc., Kailua-Kona, HI (US)

( * ) Notice: Subject to any disclaimer, the term of this patent is extended or adjusted under 35 U.S.C. 154(b) by 13 days.

(21) Appl. No.: 15/425,893

(22) Filed: Feb. 6, 2017

(65) Prior Publication Data

US 2017/0225841 A1 Aug. 10, 2017

Related U.S. Application Data

(60) Provisional application No. 62/292,290, filed on Feb. 6, 2016.

(51) Int. Cl.

| | |
|---|---|
| ***B65D 33/02*** | (2006.01) |
| ***B65D 33/08*** | (2006.01) |
| ***B65F 1/00*** | (2006.01) |
| ***B65F 1/14*** | (2006.01) |

(52) U.S. Cl.
CPC ..... *B65D 33/08* (2013.01); *B65F 1/0006* (2013.01); *B65F 1/14* (2013.01)

(58) Field of Classification Search
CPC ..... B65D 33/08
USPC ..... 383/9, 10, 17
See application file for complete search history.

(56) References Cited

U.S. PATENT DOCUMENTS 3,987,959 A * 10/1976 Deards ..... B65D 33/02 383/10
5,120,553 A * 6/1992 Kupcikevicius ..... B65D 75/563 206/497
5,286,503 A * 2/1994 Kupcikevicius ..... B65B 61/14 383/10
5,332,094 A * 7/1994 Cilia ..... B29C 65/7433 206/497
5,354,193 A * 10/1994 Kupcikevicius ..... B65B 61/14 425/403
5,393,293 A * 2/1995 Cilia ..... B29C 65/7433 206/497
5,576,037 A * 11/1996 Moore, Jr. ..... B65D 75/002 206/497

* cited by examiner

*Primary Examiner* — Jes F Pascua
(74) *Attorney, Agent, or Firm* — Sean D. Burdick

(57) ABSTRACT

A handle body is formed in a lower end of a bag between a transverse bottom seal and an intermediate handle seal. The handle body has a deflected weld line having a midpoint and end points, and is nearest to the transverse bottom seal at the midpoint. The deflected weld line is arranged so that a line tangent to the deflected weld line at either end point defines an angle greater than or less than 90 degrees with respect to a second line running transversely through the midpoint. Between the midpoint and the end points, the deflected weld line can include different combinations of perforated, non-perforated, welded, and nonwelded line segments.

20 Claims, 9 Drawing Sheets

BOTTOM-HANDLED BAG HAVING INTEGRAL ERGONOMIC HANDLE FORMED FROM DEFLECTED WELD LINE

RELATED APPLICATIONS

This application claims the benefit of U.S. Provisional Application 62/292,290 which was filed on Feb. 6, 2016 and which is fully incorporated herein by reference.

BACKGROUND OF THE INVENTION

Field of the Invention

The present invention relates to handle designs for bags such as plastic trash bags. More specifically, the invention relates to forming integral ergonomically safe handles within a handle area defined at the bottom end of a bag.

Description of Related Art

Assignees of the present invention have designed ergonomic trash bags equipped with lower handles that help reduce workplace injuries. These bags are marketed as LiteLift® bags, and are described in U.S. Pat. No. 8,790,009 and U.S. patent application Ser. No. 13/601,924, the specifications of which are fully incorporated herein by reference. As described in these specifications, the ergonomic trash bag is constructed of plastic film. Typically, the bags are made from a continuous sheet of extruded tubular film that is run through machinery that forms the film into rolls of perforated bags. Generally, each bag has an open top for receiving items into a containment portion defined between layers of the film, a transverse bottom seal sealing together the layers of film at an end of the bag opposite the open top, a handle seal sealing together the layers of film to define a bottom end of the containment portion, and a handle body formed between the handle seal and the transverse bottom seal. The problem addressed in the present disclosure is how to form a graspable handle through the film of the handle body that is tear-resistant and that allows for realization through good manufacturing practice.

U.S. Pat. No. 6,231,232 to Charles J. Warr addresses a similar problem. In his disclosure, Warr teaches the formation of a hand-insertion slit formed in a handle area of the bag between two spaced-apart seal lines. The hand insertion slit is cut horizontally through the walls of the bag, with two arcuate end split portions formed on each end of the horizontal cut. Warr's invention includes forming the arcuate end split portions so that each defines an arc greater than or equal to 180 degrees, such that each arc also extends below the horizontal cut by an arc length of between 0 and 45 degrees. Essentially, Warr teaches angling the ends of the hand-insertion slit inward and away from the nearest perimeters of the bag to improve the strength, or tear-resistance, of the handle.

While Warr's approach seeks to improve the strength of the handle, it introduces new problems during manufacturing, particularly where the bags are formed from thin-film plastics. The first new problem is that the hand insertion slit, which is cut through all layers of the plastic film, creates a flap of plastic that can be hazardous as the film is being run through various stages in its forming apparatus. The flap tends to fold over and get caught in various components of machinery, causing tears and jamming. The second problem occurs when the arcuate end portions of Warr's hand-insertion slit are formed as cut-outs. The circular portions of film that are removed to form the cut-outs tend to disperse and jam the bag-making machinery, and also create debris that requires additional resources to remediate.

What is needed is a new design for bag handles that is tear-resistant, that reduces defects, and that enables better manufacturing reliability.

SUMMARY OF THE INVENTION

The present invention discloses improvements in the design of the handle area for bags such as trash bags formed from thin-filmed plastic. A handle area for a bag according to the invention improves the safety of the handle by incorporating a load-limiting feature that allows the handle to fail when the bag is overloaded to discourage unsafe handling. Other features of the invention provides handle designs for improving the strength of the handle, and for avoiding the creation of flaps or debris that can interfere with bag manufacturing apparatus.

In one embodiment, a bag according to the invention has an open top for receiving items into a containment portion defined between layers of film, a transverse bottom seal sealing together the layers of film at an end of the bag opposite the open top, a handle seal sealing together the layers of film to define a bottom end of the containment portion, and a handle body formed between the handle seal and the transverse bottom seal. A deflected weld line is defined within the handle body and configured so that it has a midpoint and two end points, and so that the deflected weld line is nearest to the transverse bottom seal at the midpoint. The deflected weld line is arranged so that a line tangent to the deflected weld line at either end point defines an angle greater than or less than 90 degrees with respect to a second line running transversely through the midpoint. Between the midpoint and the end points, the deflected weld line can include different combinations of perforated, nonperforated, welded, and nonwelded line segments.

Various alternative embodiments are also disclosed. The deflected weld line may be curved, crescent shaped, or may consist of two straight lines joined at the midpoint. The deflected weld line may substantially centered within the handle body. The end points may be equidistant from the transverse bottom seal, or the end points may form right and left end points that are equidistant from the midpoint. The deflected weld line may include one or more perforated welded segments that weld together the layers of film that form the bag. In another embodiment, the deflected weld line includes at least one perforated welded segment, at least one nonperforated welded segment, and at least one nonwelded segment, wherein the at least one perforated welded segment and the at least one nonperforated welded segment weld together the layers of film. In another embodiment the deflected weld line defines a sealed pocket between the layers of film. Indicia such as an RFID tag may be located within the sealed pocket.

In another embodiment, a bag according to the invention has an open top for receiving items into a containment portion defined between layers of film, a transverse bottom seal sealing together the layers of film at an end of the bag opposite the open top, a handle seal sealing together the layers of film to define a bottom end of the containment portion, and a handle body formed between the handle seal and the transverse bottom seal. A deflected weld line is defined within the handle body. The deflected weld line includes at least one nonperforated welded segment, at least one perforated welded segment, and at least one nonwelded segment. One variation of this embodiment includes a deflected weld line having a perimeter that defines an elliptical area. Another variation of this embodiment includes a deflected weld line having a perimeter that defines an allantoidal area.

BRIEF DESCRIPTION OF THE DRAWINGS

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims. Component parts shown in the drawings are not necessarily to scale, and may be exaggerated to better illustrate the important features of the invention. Dimensions shown are exemplary only. In the drawings, like reference numerals may designate like parts throughout the different views, wherein:

DETAILED DESCRIPTION OF THE INVENTION

Figure 1:
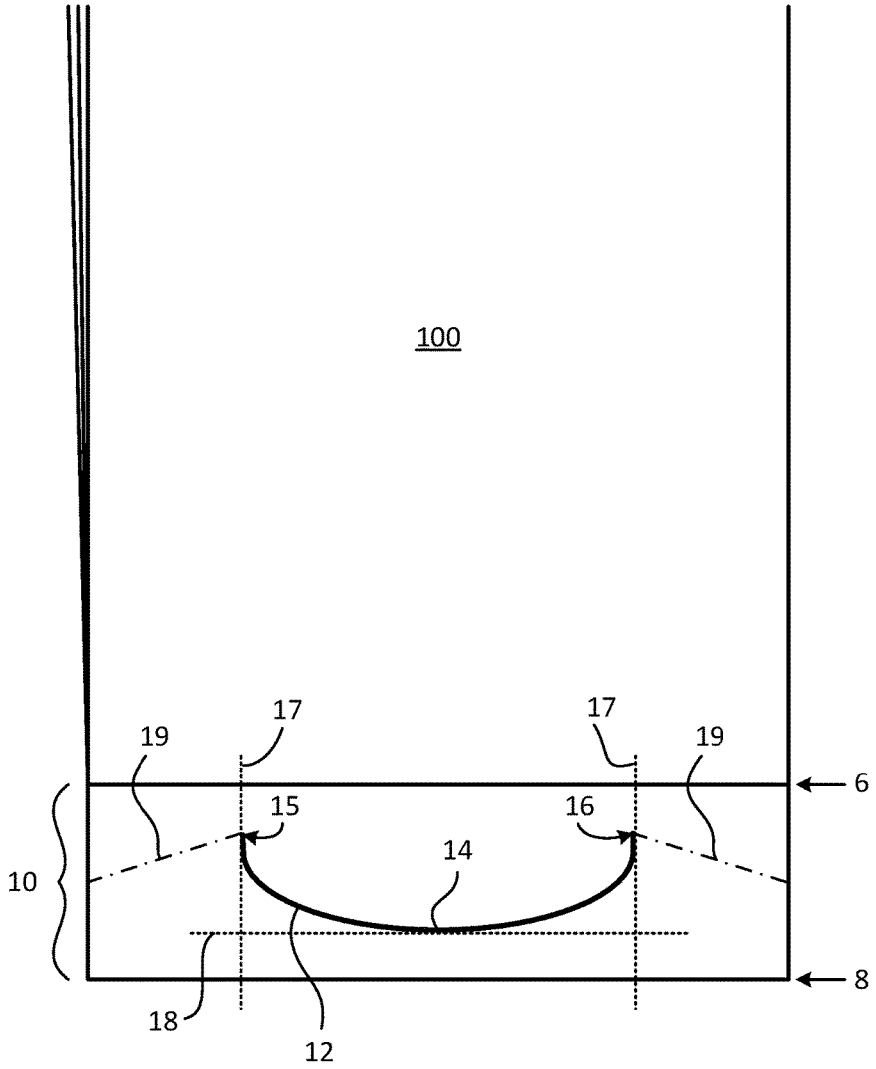
FIG. 1 PRIOR ART
FIG. 1 is a side view of a bottom-handled bag having a known configuration for a handle body and a weld line cut through the handle body.

The present invention discloses improvements in the design of the handle area of thin-filmed plastic bags. A handle area for a bag according to the invention improves the safety of the handle by incorporating a load-limiting feature that allows the handle to fail when the bag is overloaded to discourage unsafe handling. Other features of the invention provides handle designs for improving the strength of the handle, and for avoiding the creation of flaps or debris that can interfere with bag manufacturing apparatus.

Handles according to the present invention comprise a deflected weld line defined within the handle body. A deflected weld line is a linear image formed, for example, within a handle area composed of multiple layers of plastic film. The linear image surrounds an area that may be easily punched through by hand, to allow a user to grasp the bag through the punched-out area. This handle hole area may be substantially centered within the handle area of the bag, either horizontally, vertically, or both horizontally and vertically. In one example, substantially centered means that the center point of an imaginary minimum rectangle that encloses the deflected weld line coincides with the center point of the handle body.

The term "deflected" means that the line image does not consist solely of a straight line. A deflected weld line may have at least one curved segment, or may comprise multiple curved segments, or may be angular, i.e., consisting of multiple straight segments, or may comprise a combination of straight and curved segments. A deflected weld line may be a single continuous line with a midpoint and two end points, or it may form the perimeter of a geometric shape such as a circle or ellipse. A deflected weld line may also comprise multiple disconnected line segments that form an overall linear image, wherein the line segments of the deflected weld line are separated by nonwelded tags of very short length relative to the length of the adjacent line segments. The line segments themselves comprise welded lines that weld together the layers of plastic film. The welded line segments may be either perforated or nonperforated line segments. A perforated welded line segment creates a linear hole through the handle area that is welded along both sides of the linear hole. Therefore, a deflected weld line according to the invention may comprise one or more of nonwelded segments, perforated welded segments, and nonperforated welded segments. Several examples of deflected weld lines are shown in the accompanying figures.

Generally, the purpose of the nonwelded segments, or tags, is to maintain the handle hole area defined by the deflected weld line attached to the bag during the manufacturing process. This prevents loose pieces of plastic film from jamming the machinery, or creating an undesirable accumulation of waste material. The nonwelded segments must have a size substantial enough to ensure that the handle hole area is held in place during manufacture, but minute enough to be easily torn away when the handle hole area is punched out during use. The nonperforated welded segments and the perforated welded segments assist in achieving these objectives.

In one embodiment, the nonwelded segments are arranged symmetrically about the midpoint of the deflected weld line. In another embodiment, the nonwelded segments are arranged symmetrically around the deflected weld line.

During testing of various different configurations for deflected weld lines, the applicants hereof realized that heavy gauge bags equipped with an ergonomic handle according to the invention may promote the ability to lift greater weight than would otherwise be achievable using a conventional trash bag and handle. In testing three designs for tear resistance, it was discovered that the direction of tear differs according to the deflected weld line configuration and film thickness. In each test, tear-resistance testing was performed by loading the bag to place tension on the lower handle such that the direction of tension was perpendicular to the transverse weld lines 6 and 8 shown in the figure. The bags under test were formed from polyethylene film, which is typically extruded with an inline or transverse molecular structure.

FIG. 1 shows a bag 100 of known design that has a lower handle area 10. The lower handle area 10 is bordered at top and bottom by transverse weld lines 6 and 8. Lower handle area 10 includes a deflected weld line 12 that forms a half-oval-shaped image. The deflected weld line 12 may be either a perforated weld line or a nonperforated weld line, or some combination of the two. The deflected weld line 12 has a lowermost midpoint 13 and two uppermost end points 15 and 16. At either end point, a line 17 tangent to the deflected weld line 12 forms a 90-degree angle with respect to a line 18 running transversely through the midpoint 14. Such an end point 15 or 16 is referred to herein as a "90-degree end point". This configuration when tested caused tear lines 19 to occur in a direction generally parallel to the transverse weld lines 6 and 8. Configuration 10 has the most frequent failure rate at loads at or below the 51-lb recommended weight limit (RWL) of the National Institute for Occupational Safety and Health (NIOSH). See Table 1 below. As demonstrated below, non-90-degree end points exhibit stronger tear resistance.

Figure 2:
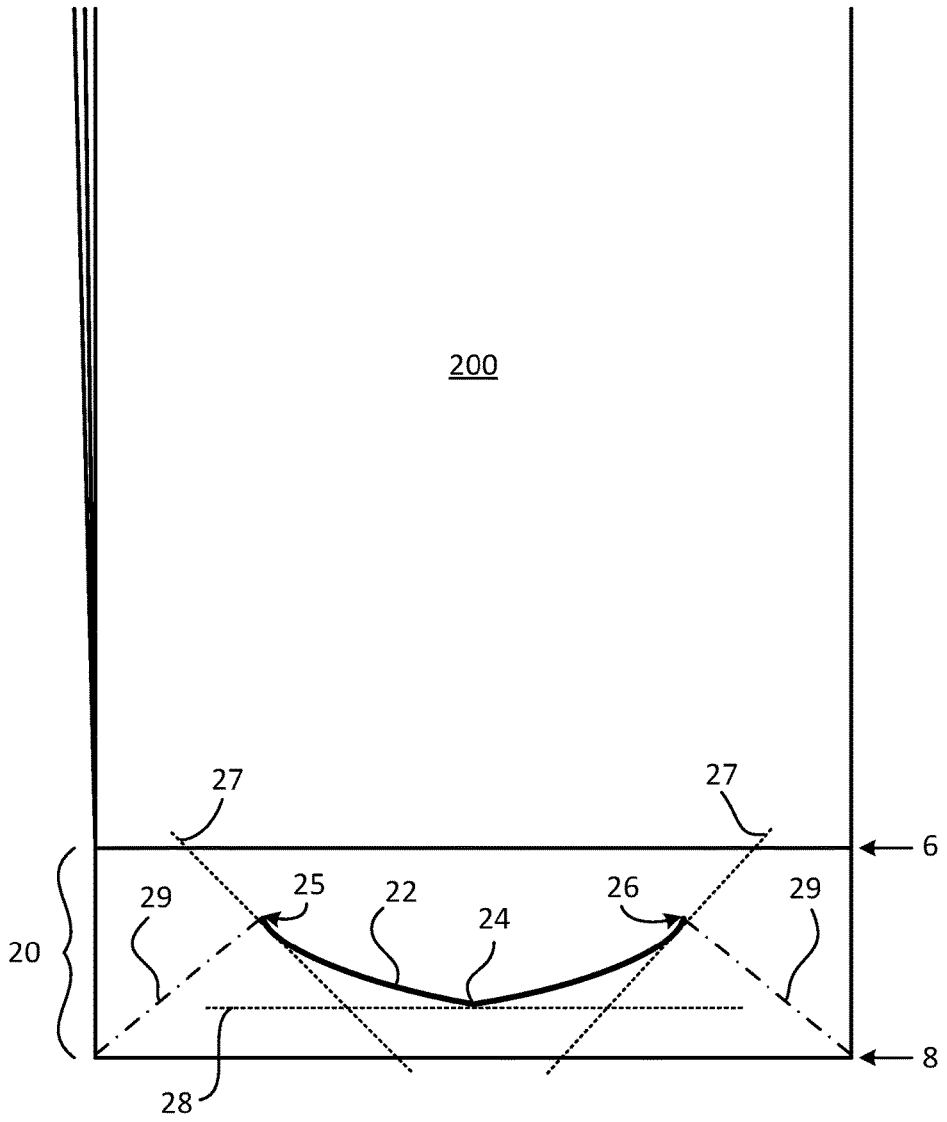
FIG. 2 is a side view of a bag according to the present invention having a lower handle area with a handle formed from a 45-degree deflected weld line.

FIG. 2 shows an embodiment of a bag 200 according to the invention that has a lower handle area 20. The lower handle area 20 is bordered at top and bottom by transverse weld lines 6 and 8. Lower handle area 20 includes a deflected weld line 22 that forms a crescent-shaped image. The deflected weld line 22 may be either a perforated weld line or a nonperforated weld line, or some combination of the two. The deflected weld line 22 has a lowermost midpoint 24 and two uppermost end points 25 and 26. At each end point, a line 27 tangent to the deflected weld line 24 forms a 45-degree angle with respect to the transverse weld lines 6 and 8, or with respect to a line 28 running transversely through the midpoint 24. Such an end point 25 or 26 is referred to herein as a "45-degree end point". This configuration when tested caused tear lines 29 to occur in a diagonal direction from end point 25 or 26 toward a bottom corner of the bag. The tear lines 29 were observed to propagate more slowly than the tear lines 19 that occurred for bag 100.

The configuration of lower handle area 20 consistently met the NIOSH RWL of 51 lbs before failure, and would consistently begin to fail at load limits between 51 lbs and 70 lbs. See Table 1 below. While other configurations of a lower handle area (e.g. FIG. 3) may create a stronger handle than configuration in FIG. 2, the configuration of lower handle area 20 provides a structure that is more ergonomically safe, because if a user grasps the handle to lift a loaded bag and the handle begins to tear, this signals the user that the load exceeds the NIOSH RWL and therefore presents an unsafe lifting condition that could result in injury. The user could then distribute the load into two or more bags. In this respect, the configuration of lower handle area 20 provides an integral "mechanical fuse"—or load-limiting feature—that will allow the deflected weld line 24 to tear away (along tear lines 29) when the load exceeds a predetermined safety limit such as the NIOSH RWL. Bags according to the invention may be configured to adjust the film thickness and the travel distance of the diagonal tear line to achieve different load ratings (i.e. safety limits) for bags.

Figure 3:
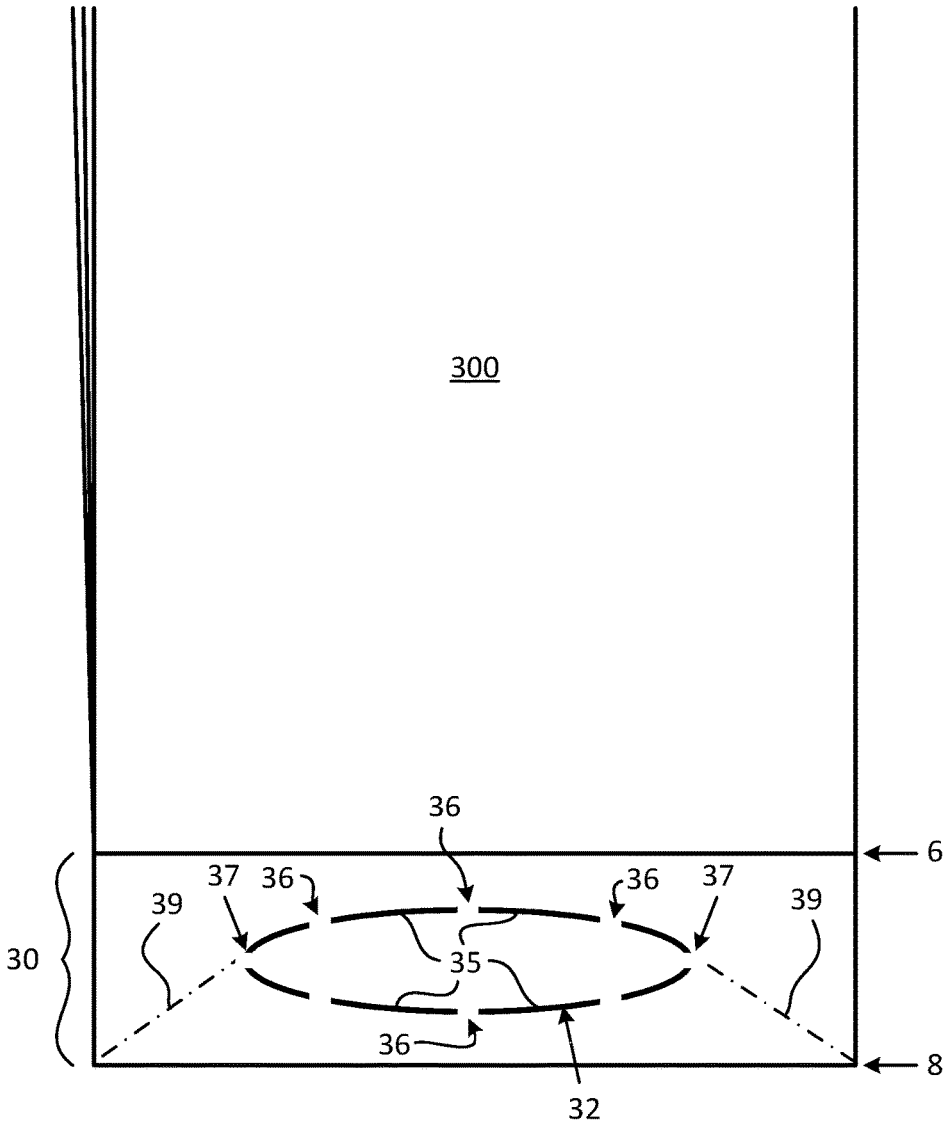
FIG. 3 is a side view of a bag according to the present invention having a lower handle area with a handle formed from a deflected weld line in the shape of an ellipse.

FIG. 3 shows an embodiment 300 of a bag according to the invention that has a lower handle area 30. The lower handle area 30 is bordered at top and bottom by transverse weld lines 6 and 8. Lower handle area 30 includes a deflected weld line 32 that forms an elliptical image. The deflected weld line 32 consists of multiple curved segments 35 that are each separated by a relatively short nonwelded segment or tag 36. Each curved segment 35 may be either a perforated weld line or a nonperforated weld line, or a combination of the two. The configuration of lower handle area 30 when tested caused diagonal tear lines 39 to run from a point 37 on a curved segment 35 at the right and left sides of the ellipse to the bottom transverse seal 8. This configuration, referred to herein as a "deflected circumference" weld line, exhibited the best failure rate and withstood loads of 70 lbs or greater across all gauges tested. See Table 1 below.

Figure 4:
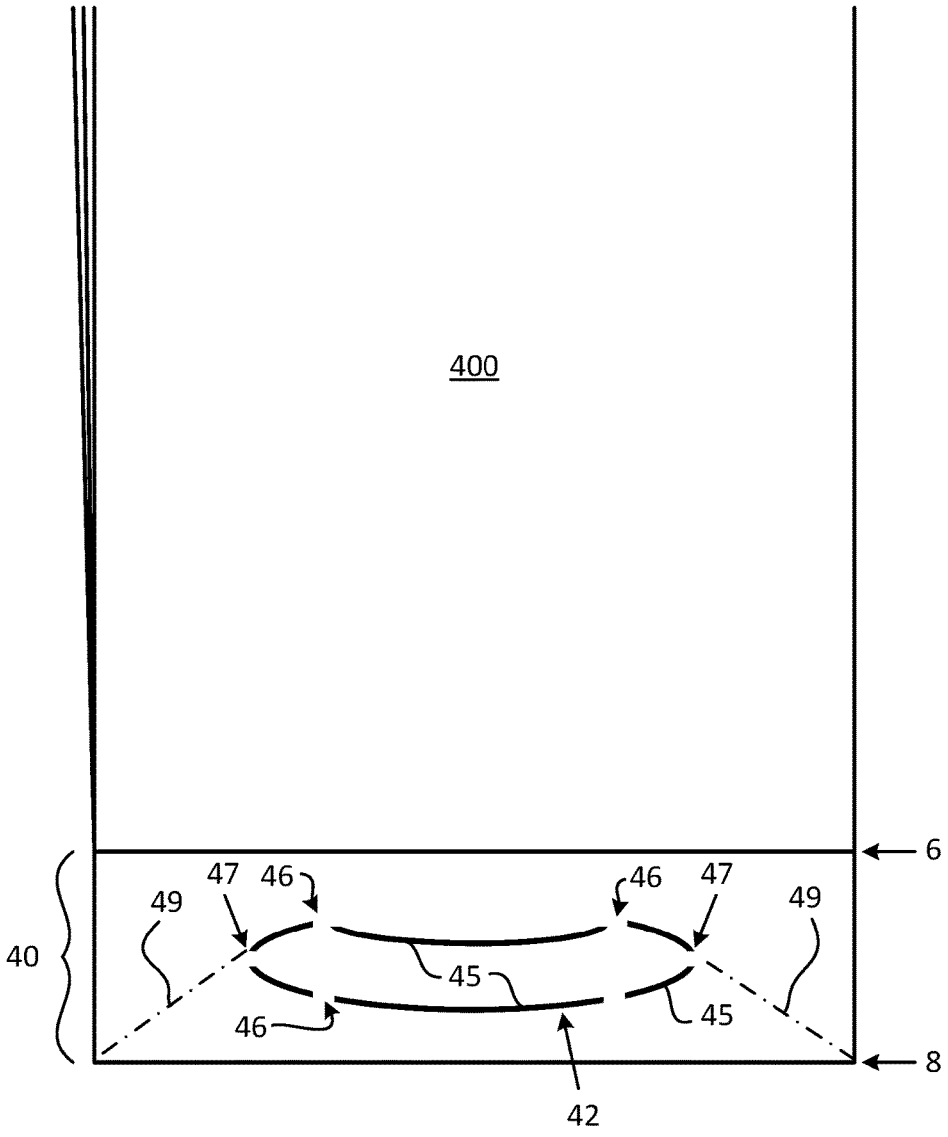
FIG. 4 is a side view of a bag according to the present invention having a lower handle area with a handle formed from a deflected weld line having an allantoidal shape.

FIG. 4 shows an alternative embodiment 400 of a bag according to the invention that has a lower handle area 40. The lower handle area 40 is bordered at top and bottom by transverse weld lines 6 and 8. Lower handle area 40 includes a deflected weld line 42 that forms an allantoidal or "sausage-shaped" image. The deflected weld line 42 consists of multiple curved segments 45 that are each separated by a relatively short nonwelded segment or tag 46. Each curved segment 45 may be either a perforated weld line or a nonperforated weld line, or a combination of the two. This configuration is another type of "deflected circumference" weld line. Load test results for lower handle area 40 are similar to those listed for lower handle area 30. The dashed lines 49 show the direction of tear from a point 47 to a corner of the bag when the handle area 40 is subjected to loading as described herein for testing conducted on other embodiments. The configuration of lower handle area 40 exhibits a superior load rating due to the absence of 90-degree end points. In other embodiments, a deflected weld line according to the inventive principles disclosed herein may form images that trace out geometric areas other than elliptical and allantoidal without departing from the scope of the invention.

Figure 5:
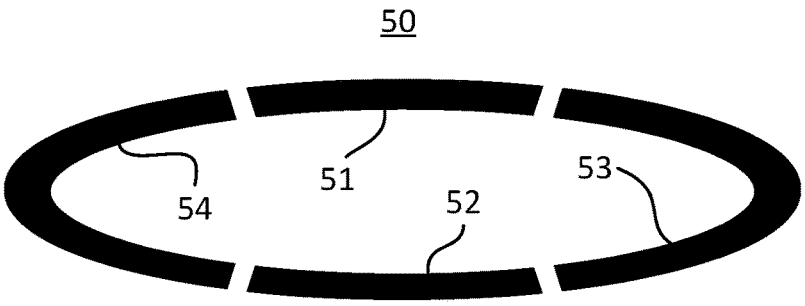
FIG. 5 is a diagram of one embodiment of a deflected weld line according to the present invention having an elliptical shape and a combination of welded and nonwelded segments.
Figure 6:
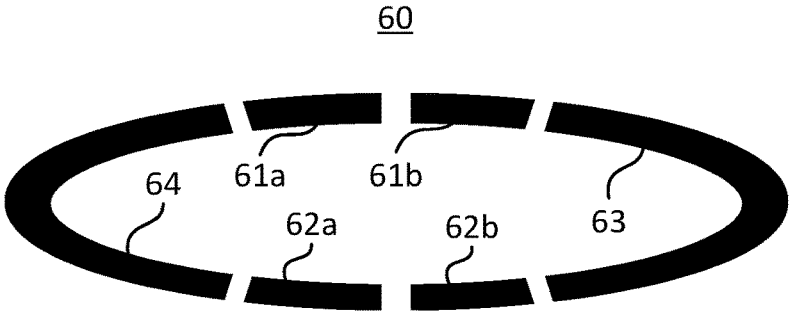
FIG. 6 is a diagram of another embodiment of a deflected weld line according to the present invention having an elliptical shape and an alternative combination of welded and nonwelded segments.
Figure 7:
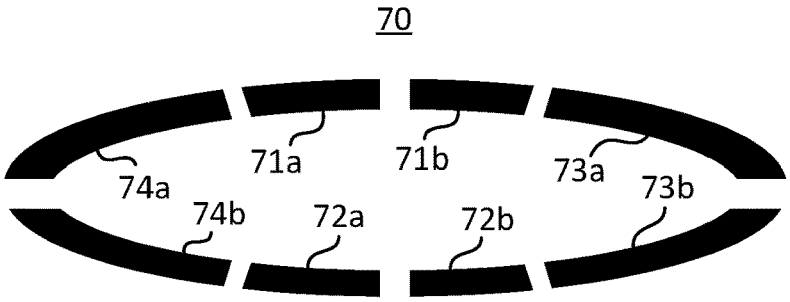
FIG. 7 is a diagram of another embodiment of a deflected weld line according to the present invention having an elliptical shape and an alternative combination of welded and nonwelded segments.
Figure 8:
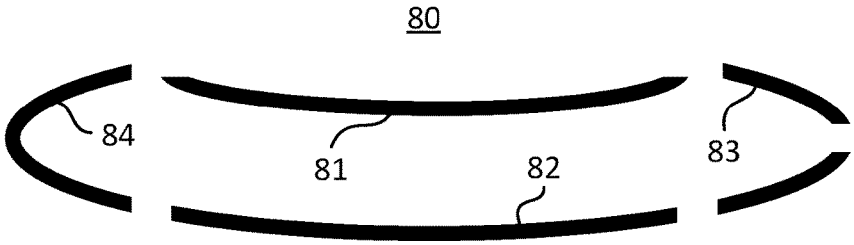
FIG. 8 is a diagram of one embodiment of a deflected weld line according to the present invention having an allentoidal shape and a combination of welded and non-welded segments.
Figure 9:
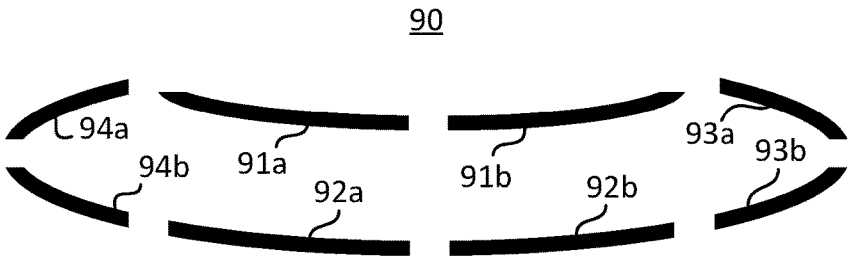
FIG. 9 is a diagram of another embodiment of a deflected weld line according to the present invention having an allentoidal shape and an alternative combination of welded and nonwelded segments.

FIGS. 5 to 9 illustrate other embodiments of handle images defined by deflected weld lines according to the invention. FIG. 5 shows an elliptical deflected weld line 50 having four nonwelded segments symmetrically located to divide the weld line 50 into four curved perforated or nonperforated welded segments—an upper curve 51, a lower curve 52, a right end curve 53, and a left end curve 54. FIG. 6 shows an elliptical deflected weld line 60 that is similar to the configuration of weld line 50, but adds two additional nonwelded segments at midpoints in the upper and lower curves to divide the weld line into six total perforated or nonperforated welded segments—upper curves 61*a* and 61*b*, lower curves 62*a* and 62*b*, a right end curve 63, and a left end curve 64. FIG. 7 shows an elliptical deflected weld line 70 that is similar to the configuration of weld line 60, but adds two additional nonwelded segments at midpoints in the right end and left end curves to divide the weld line into a total of eight perforated or nonperforated welded segments—upper curves 71*a* and 71*b*, lower curves 72*a* and 72*b*, right end curves 73*a* and 73*b*, and left end curves 74*a* and 74*b*. FIG. 8 shows an allantoidal deflected weld line 80 having four nonwelded segments that divide the weld line into four perforated or nonperforated welded segments—upper curve 81, lower curve 82, right end curve 83, and left end curve 84. FIG. 9 shows an allantoidal deflected weld line 90 having eight nonwelded segments that divide the weld line into eight perforated or nonperforated welded segments—upper curves 91*a* and 91*b*, lower curves 92*a* and 92*b*, right end curves 93*a* and 93*b*, and left end curves 94*a* and 94*b*. Skilled artisans will recognize that many other configurations of deflected weld lines comprising any number of straight or curved segments are possible within the scope of the invention, wherein each segment consists of a perforated or nonperforated welded segment, and where the segments may be separated by nonwelded segments.

Table 1 below shows load testing data for the tests conducted on bags having lower handle configurations 10, 20, and 30. For each test, the specimen tested is listed in the left-most column, where HDPE indicates high-density polyethylene and LDPE indicates low-density polyethylene, i.e. the material composition of the bag under test. Overall thickness of the tested material is also listed in mils or microns. Lower handle area configurations are listed in three columns. Beneath each column is listed the mean failure load for each corresponding test specimen, i.e. the average load among five identically configured test specimens at which the handle area failed. Each test was performed by loading weight (recorded in pounds) into a test specimen and lifting it by the lower handle against gravity. Weight was added for each test specimen until failure was observed, i.e. tearing of the handle. Number in parentheses indicate no failure at the maximum test weight of 70 lbs.

TABLE 1

Test Results for Handles Having Deflected Weld Lines

| Material/Size | 90-degree Failure (lbs) | 45-degree Failure (lbs) | Deflected Circumference Failure (lbs) |
|---|---|---|---|
| HDPE, 12 micron | 27 | 48 | (70+) |
| HDPE, 14 micron | 32 | 53 | (70+) |
| HDPE, 16 micron | 36 | 67 | (70+) |
| LDPE, 1.5 mil | 40.5 | 69 | (70+) |
| LDPE, 2.0 mil | 51.5 | (70+) | (70+) |
| LDPE, 3.0 mil | (70+) | (70+) | (70+) |

Figure 10:
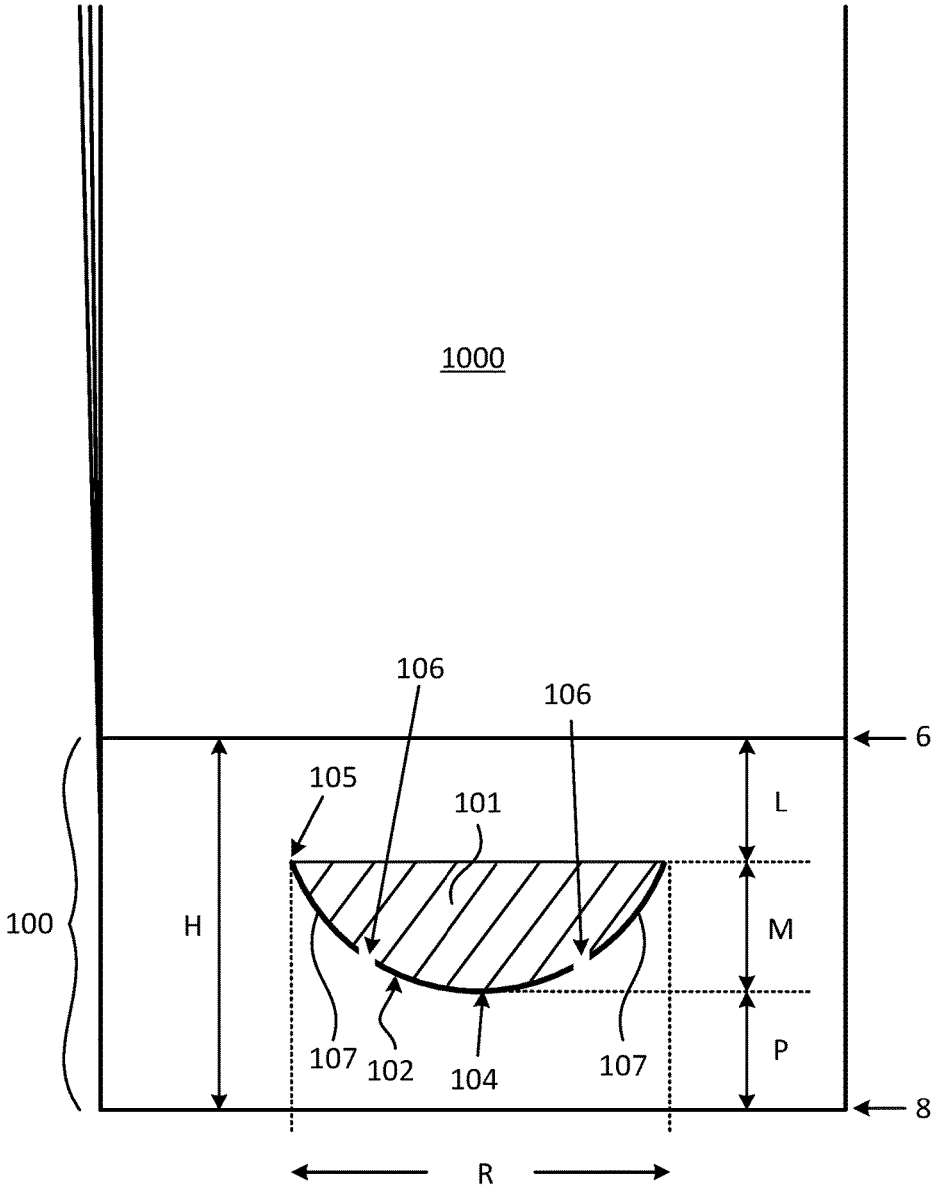
FIG. 10 is a side view of an embodiment according to the invention of a lower-handled bag having a deflected weld line with welded and non-welded segments that form a crescent-shaped handle with 45-degree end points.

FIG. 10 shows one embodiment of a bag handle 1000 according to the present invention having a deflected weld line 102 defined substantially centrally within the handle area 100 of the bag 1000. A 45-degree end point is shown at 105. Two nonwelded segments 106 are shown symmetrically arranged about the midpoint 104 and between curved segments 107 that may be either welded perforations or nonwelded perforations. Dimensions shown are exemplary only. Handle 100 may have a height H of about 3 inches. Dimensions L, M, and P may be about one inch each. Dimension R may be between about 3 and about 5 inches, depending on the width of the bag bottom. The cross-hatched area 101 above the crescent-shaped deflected weld line may define a sealed pocket between layers of film.

Figure 11:
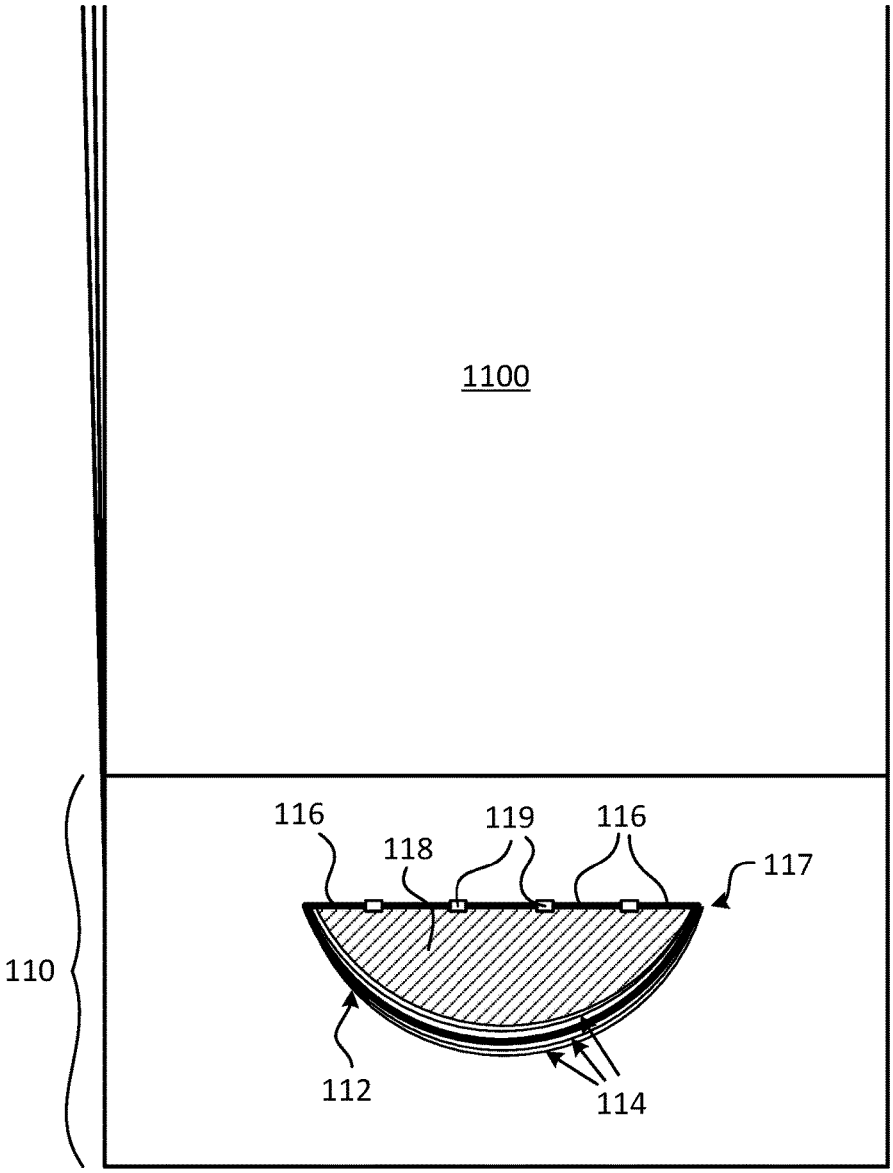
FIG. 11 is a side view of an embodiment according to the invention of a lower-handled bag having a deflected weld line with an unwelded crescent-shaped handle cut, and a transverse weld line having welded and nonwelded segments.

FIG. 11 illustrates an unwelded handle cut that may be employed in various embodiments of the present invention. Lower handle area 110 of bag 1100 consists of multiple layers 114 of plastic film. In this example, a non-welded perforated deflected handle line 112 has been cut through all layers of the bag 1100 in a crescent-shaped arc. A transverse seal 117 has been formed above the crescent-shaped flap 118 to seal together all layers of the bag along the transverse weld line. Transverse seal 117 consists of multiple nonperforated weld segments 116 separated by perforated weld lines 119 that are defined along the transverse seal. Because deflected handle line 112 is not heat-welded, the layers 114 of flap 118 are separable. These layers 114 may be torn away by hand from the handle area 110 along the transverse seal 117 as the nonperforated weld segments 116 stretch under the tearing force until also perforated. In another embodiment, deflected weld line 112 may be heat-welded, forming a continuous curved perforation through all layers of the bag 1100, and sealing together the layers along the weld line.

Figure 12:
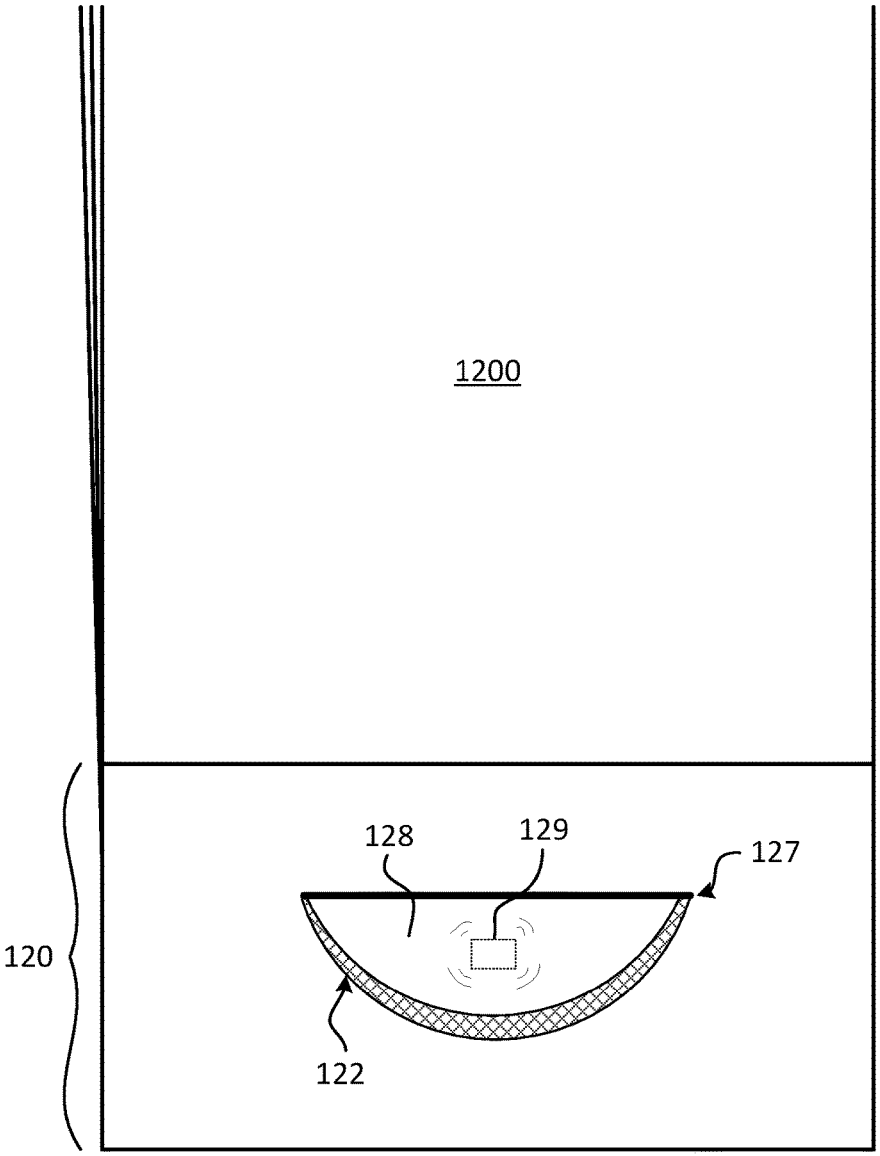
FIG. 12 is a side view of an embodiment according to the invention of a lower-handled bag having a deflected weld line with a welded crescent-shaped handle cut and a transverse weld line having a continuous weld.

FIG. 12 illustrates a welded handle cut that may be employed in various embodiments of the present invention. Lower handle area 120 of bag 1200 consists of multiple layers of plastic film. In this example, a deflected weld line 122 has been cut through all layers of the bag 1200 in a crescent-shaped arc. A transverse seal 127 has been heat-welded above the crescent-shaped flap 128 to seal together all layers of the bag along the transverse weld line. Transverse seal 127 is a nonperforated weld that joins the ends of the crescent without cutting a linear hole through the film. Because deflected weld line 122 is also heat-welded, the layers of flap 128 are not separable, and the flap 128 forms a multi-layered pocket bordered by a continuous weld. Deflected weld line 122 may form a continuous curved perforation through all layers of the bag 1200, sealing together the layers along the weld line. Other embodiments of deflected weld lines are possible that are composed of different combinations of perforated, nonperforated, welded, and nonwelded line segments. For example, a deflected weld line 122 may have at least one perforated welded segment, at least one nonperforated welded segment, and at least one nonwelded segment, wherein the at least one perforated welded segment and the at least one nonperforated welded segment weld together the layers of film.

A further improvement to the handle design of bags according to the present invention provides a means for identifying bags. To achieve this objective, an RFID tag 129 may be placed or affixed within a sealed pocket 128 formed on the bag. In one embodiment, the sealed pocket is formed in the handle area 120 between layers of film. In another embodiment, the sealed pocket is at least partially defined by the deflected weld line 122 that provides a handle, as described above. For example, the sealed pocket may be formed within the area defined by the crescent shaped deflected weld line of lower handle area 120, and a transverse weld 127 running from end point to end point. In another example, the sealed pocket may be formed within the area defined by the elliptical or allantoidal handle shapes of lower handle area 30 or 40. Bags so equipped with an RFID tag 129 provide a means for uniquely identifying each bag. This advantageously allows for reliable tracking and discovery of dispositioned bags in industries where verification of proper waste disposal is an important part of quality assurance, for example, for the disposal of contaminated waste, medical waste, waste from crime scene investigations, or disposal of other controlled substances.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A bag having an open top for receiving items into a containment portion defined between layers of film, a transverse bottom seal sealing together the layers of film at an end of the bag opposite the open top, a handle seal sealing together the layers of film to define a bottom end of the containment portion, and a handle body formed between the handle seal and the transverse bottom seal, wherein the improvement comprises:

a deflected weld line defined within the handle body and defining a sealed pocket between the layers of film; and an RFID tag located within the sealed pocket.

2. The bag of claim 1 wherein the deflected weld line further comprises one or more perforated welded segments that weld together the layers of film.

3. The bag of claim 1 wherein the deflected weld line further comprises one or more nonperforated welded segments that weld together the layers of film.

4. The bag of claim 1 wherein the deflected weld line forms a perimeter of an elliptical area.

5. A bag having an open top for receiving items into a containment portion defined between layers of film, a transverse bottom seal sealing together the layers of film at an end of the bag opposite the open top, a handle seal sealing together the layers of film to define a bottom end of the containment portion, and a handle body formed between the handle seal and the transverse bottom seal, wherein the improvement comprises:

a deflected weld line defined within the handle body, the deflected weld line comprising at least one nonperforated welded segment, at least one perforated welded segment, and at least one nonwelded segment;

wherein the deflected weld line defines a sealed pocket between the layers of film; and wherein the bag further comprises an RFID tag located within the sealed pocket.

6. The bag of claim 5 wherein the deflected weld line forms a perimeter of an elliptical area.

7. The bag of claim 5 wherein the deflected weld line forms a perimeter of an allantoidal area.

8. A bag having an open top for receiving items into a containment portion defined between layers of film, a transverse bottom seal sealing together the layers of film at an end of the bag opposite the open top, a handle seal sealing together the layers of film to define a bottom end of the containment portion, and a handle body formed between the handle seal and the transverse bottom seal, wherein the improvement comprises:

a deflected weld line defined within the handle body, the deflected weld line having a midpoint and at least one end point, the deflected weld line being nearest to the transverse bottom seal at the midpoint;

wherein the deflected weld line is configured so that a first line tangent to the deflected weld line at the at least one end point defines an angle greater than or less than 90 degrees with respect to a second line running transversely through the midpoint;

wherein the deflected weld line comprises one or more nonwelded segments located between the midpoint and the at least one end point;

wherein the deflected weld line defines a sealed pocket between the layers of film; and wherein the bag further comprises an RFID tag located within the sealed pocket.

9. The bag of claim 8 wherein the deflected weld line is curved.

10. The bag of claim 9 wherein the curved deflected weld line is crescent shaped.

11. The bag of claim 8 wherein the deflected weld line is substantially centered within the handle body.

12. The bag of claim 8 wherein the at least one end point comprises right and left end points that are equidistant from the transverse bottom seal.

13. The bag of claim 8 wherein the at least one end point comprises right and left end points that are equidistant from the midpoint.

14. The bag of claim 8 wherein the deflected weld line comprises a plurality of nonwelded segments.

15. The bag of claim 8 wherein the deflected weld line further comprises one or more perforated welded segments that weld together the layers of film.

16. The bag of claim 8 wherein the deflected weld line further comprises one or more nonperforated welded segments that weld together the layers of film.

17. The bag of claim 8 wherein the deflected weld line comprises at least one perforated welded segment, at least one nonperforated welded segment, and at least one nonwelded segment, wherein the at least one perforated welded segment and the at least one nonperforated welded segment weld together the layers of film.

18. The bag of claim 8 wherein the at least one end point comprises left and right end points separated by between about 3 and about 5 inches.

19. The bag of claim 8 wherein the deflected weld line is furthest from the transverse bottom seal at the at least one end point.

20. The bag of claim 8 wherein the first line tangent to the deflected weld line at the at least one end point defines an angle of about 45 degrees with respect to a second line running transversely through the midpoint.

* * * * *